US005871393A

United States Patent [19]

Shiozawa

[11] Patent Number: 5,871,393

[45] Date of Patent: Feb. 16, 1999

[54] MOUNTING MEMBER FOR POLISHING

[75] Inventor: Hajime Shiozawa, Nishinomiya, Japan

[73] Assignee: Chiyoda Co., Ltd., Osaka, Japan

[21] Appl. No.: 821,275

[22] Filed: Mar. 20, 1997

[30] Foreign Application Priority Data

Mar. 25, 1996 [JP] Japan ..... 8-094809

[51] Int. Cl.[6] ..... B24B 5/00

[52] U.S. Cl. ..... 451/285; 451/286; 451/287; 451/288; 451/289; 451/41; 451/921

[58] Field of Search ..... 451/41, 285–289, 451/921, 533

[56] References Cited

U.S. PATENT DOCUMENTS 4,954,141 9/1990 Takiyama et al. ..... 451/921
5,533,923 7/1996 Shamouilian et al. ..... 451/41
5,605,760 2/1997 Roberts ..... 451/41
5,618,227 4/1997 Tsutsumi et al. ..... 451/288
5,649,855 7/1997 Chikaki ..... 451/290
5,681,212 10/1997 Hayakawa et al. ..... 451/288

*Primary Examiner*—Robert A. Rose
*Assistant Examiner*—George Nguyen
*Attorney, Agent, or Firm*—Barnes, Kisselle, Raisch, Choate, Whittemore & Hulbert, P.C.

[57] ABSTRACT

When a mounting member employed for fine polishing of semiconductor substrates or glass substrates etc. is constituted of a combination of a sheet of continuous porous structure and a template, operating efficiency is lowered by the need to change the template; this is a factor raising production costs, and edge portions of the polishing workpiece get damaged by contact with the template, causing production of defective articles. By making the mounting member for polishing a member in which water repellence was conferred on at least a surface skin layer of a continuous sheet of porous structure, fine polishing without a template was made possible.

3 Claims, 1 Drawing Sheet

MOUNTING MEMBER FOR POLISHING

BACKGROUND OF THE INVENTION

1. Field of the Invention

The present invention relates to a mounting member for polishing employed mainly in the fine polishing of for example semiconductor substrates such as silicon or glass substrates.

2. Description of the Related Art

Conventionally, polishing of polishing workpieces of various types such as semiconductor substrates of silicon or gallium arsenide etc. or glass substrates etc. for liquid crystal displays was performed using a system for example as shown in FIG. 2. In more detail, a sheet of continuous porous construction (carrier plate) 3 made of resin was fixed on to a lower base plate 1 using an adhesive (tacky adhesive) 2. A template 4 was mounted on this sheet 3 of continuous porous construction, and a hole portion 5 into which polishing workpiece 10 was fitted was formed on this template 4.

In order to perform polishing of polishing workpiece 10, polishing workpiece 10 is first of all fitted into hole portion 5 of template 4, and this polishing workpiece 10 is mounted on to sheet 3 of continuous porous construction. Next, upper base plate 6 is lowered whilst rotating lower base plate 1 and upper base plate 6, and polishing is performed for the required period by bringing a polishing pad 7 provided on the underside of this upper base plate 6 into contact with polishing workpiece 10. An aqueous solution (slurry) 11 containing polishing powder that is used for polishing is supplied to the polishing location.

With the polishing system described above, the polishing workpiece 10 is held on continuous porous sheet 3 by the employment of template 4 in combination with continuous porous sheet 3, so any large sliding movement of polishing workpiece 10 due to the moisture of aqueous solution 11 can be prevented.

However, with the polishing system described above, it is necessary to change the template 4 in accordance with the size and/or shape of each respective polishing workpiece 10 and it is also necessary to change the template 4 if it gets damaged. The lowering in the proportion of time in which the polishing operation is actually being carried out produced by these changes of the template is a factor that increases production costs.

Furthermore, by forming hole portion 5 rather larger than polishing workpiece 10, a gap 12 is produced between the outer surface of polishing workpiece 10 and the inner surface of hole portion 5, with the result that, when polishing is carried out, the polishing workpiece 10 is able to perform sliding movement by the extent of the gap 12, bringing it into contact (collision) with template 4. As a result, the edge portion of polishing workpiece 10 gets damaged, causing defective articles to be produced.

The need for improvement in respect of these factors has become an important challenge, particularly recently, in the polishing of very large silicon wafers or glass for liquid crystals constituting a workpiece 10.

SUMMARY OF THE INVENTION

An object of the present invention is to solve the problems of the prior art system described above and to provide a mounting member for polishing whereby polishing can be performed in an uncomplicated manner and with stable quality without needing to alter the polishing equipment or polishing method.

In order to achieve this object, a mounting member for polishing according to the present invention consists in a mounting member for polishing provided on a base plate and comprising a sheet of continuous porous structure made of resin having a surface skin layer of fine porous structure; wherein water repellence is conferred on at least the surface skin layer of this sheet of continuous porous structure.

With the present invention constituted as above, since the mounting member is formed with a flat surface skin layer of fine porous structure, its contact area ratio with the polishing workpiece is close to 100%, and it exhibits the benefit of increasing adhesion to the polishing workpiece. Also, since water repellence is conferred on the resin sheet of continuous porous structure, there is no possibility of the aqueous solution containing polishing powder that is employed for polishing penetrating or being left behind adhering to the mounting member. Consequently, the aqueous solution cannot enter between the polishing workpiece and mounting member, so there is no lowering of adhesion due to the aqueous solution, so, on polishing processing, the polishing workpiece is fixed to the mounting member in opposition to the force acting on the polishing workpiece, and there is no possibility of its sliding.

That is, the mounting member shows excellent performance in holding the polishing workpiece, and can be employed for fine polishing without a template.

This effect is exhibited because water repellence is needed not just at the surface of the mounting member but also in the interior of the porous resin structure, and penetration of the aqueous solution into the interior of the porous structure is prevented by the pressure and frictional force applied during polishing.

In an embodiment of the present invention, the sheet of continuous porous structure is manufactured of polyurethane resin.

With this embodiment, a mounting member showing the above effect can be obtained easily and cheaply.

In another embodiment of the present invention, water repellence is conferred by a water repellent agent containing a fluorine-based water repellent agent in a weight ratio of at least 1%.

In this further embodiment, the holding force on the polishing workpiece and the durability of the water repellence are increased and the release characteristic of the polishing workpiece and mounting member is good, so that when polishing is completed the polishing workpiece can easily be removed from the mounting member, and the polishing workpiece can easily be exchanged in an efficient manner without damaging it.

DESCRIPTION OF THE PREFERRED EMBODIMENTS

An example of a mounting member for polishing according to the present invention and polishing equipment employing this mounting member for polishing is described below with reference to FIG. 1.

Figure 1:
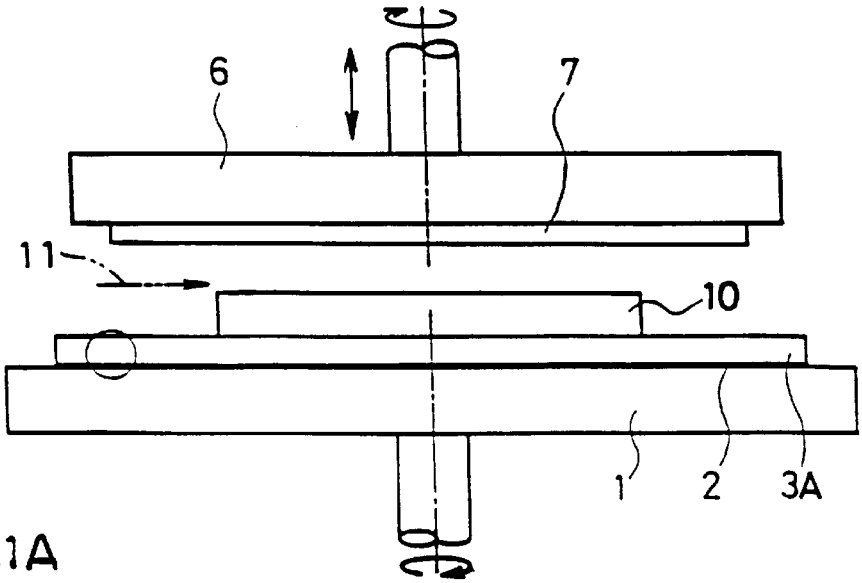
FIG. 1 is a front view of polishing equipment using a mounting member for polishing and constituting an embodiment of the present invention.
Figure 1A:
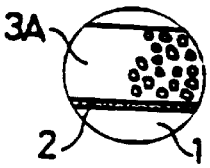
FIG. 1A is an enlargement of the portion of FIG. 1 within the circle.
Figure 2:
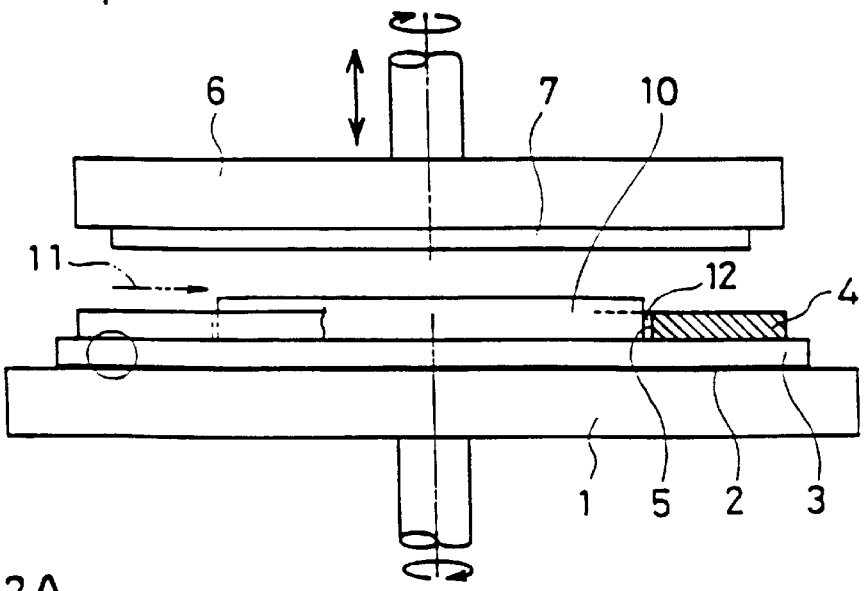
FIG. 2 is a front view, with part removed, of polishing equipment employing a mounting member for polishing and constituting a prior art example.
Figure 2A:
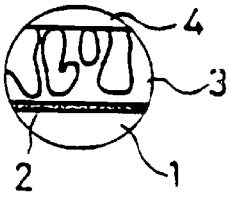
FIG. 2A is an enlargement of the portion of FIG. 2 within the circle.

In FIG. 1, the mounting member for polishing provided on lower base plate 1 consists of a sheet of continuous porous structure (carrier plate) 3A made of polyurethane resin having a surface skin layer consisting of a fine porous structure; water repellence is conferred on at least the surface skin layer of this sheet 3A of continuous porous structure.

In order to perform polishing of polishing workpiece 10, first of all, polishing workpiece 10 is placed on sheet 3A of continuous porous structure. Then, whilst rotating lower base plate 1 and upper base plate 6, upper base plate 6 is lowered so that the polishing pad 7 provided on the undersurface of this upper base plate 6 comes into contact with polishing workpiece 10 and polishing is thereby executed for the prescribed period. During this process, an aqueous solution (slurry) 11 containing the polishing powder to be employed for polishing is supplied to the location where polishing is to be effected.

Since the mounting member that is employed for the polishing in this way i.e. sheet 3A of continuous porous structure is formed with a flat surface skin layer of fine porous structure, its contact area ratio with polishing workpiece 10 is close to 100%, and good adhesion to polishing workpiece 10 is obtained. Also, since water repellence has been conferred on sheet 3A made of polyurethane resin of continuous porous structure, the moisture of aqueous solution 11 cannot penetrate sheet 3A of continuous porous structure and there is thus no possibility of its adhering and being left behind. Consequently, aqueous solution 11 cannot enter between polishing workpiece 10 and sheet 3A of continuous porous structure, so there is no loss of adherence due to aqueous solution 11, and the polishing workpiece 10 is fixed to sheet 3A of continuous porous structure in opposition to the force applied to polishing workpiece 10 during polishing processing, with no possibility of slippage.

In the embodiment described above, sheet 3A of continuous porous structure was taken to be made of polyurethane resin. However, it could be made of acrylic resin or polysulfone resin.

EMBODIMENT 1

A coating consisting of 16% of polyurethane resin, 83% of dimethyl formamide, and 1% of pigment was applied on to polyester film. This polyester film was then immersed in a liquid consisting of 93% water and 7% dimethyl formamide at a liquid temperature of 30° C., so that polyurethane resin solidified thereon. After this had solidified, it was washed with water and dried, to obtain a sheet of polyurethane resin of continuous porous structure having a surface skin layer of fine porous structure of thickness 0.45 mm.

This sheet of continuous porous structure made of polyurethane resin was stuck on to a polyester film beforehand using a cross-linking urethane resin adhesive and then impregnated by immersion with a water repellent treatment liquid made up of 15% of fluorine-based water repellent agent, 2% higher fatty acid water repellent agent, 10% isopropyl alcohol, and 73% water, then dried and subjected to heat treatment for 5 minutes at 150° C.

The sheet of continuous porous structure thus obtained was fixed on to a lower base plate as mounting member for polishing of glass for use in liquid crystals, using an adhesive (tacky adhesive), and a polishing operation was conducted for 35 hours without use of a template. During this polishing operation, there were no incidents at all such as slippage of the polishing workpiece.

EMBODIMENT 2

A coating consisting of 16% of polyurethane resin, 77% of dimethyl formamide, 5.5% of fluorine-based water repellent agent, and 1.5% of pigment was applied on to a polyester filament textile that had been subjected beforehand to release treatment. This polyester filament textile was immersed in a liquid consisting of 93% water and 7% dimethyl formamide at a liquid temperature of 30° C. so that the polyurethane resin was solidified; after its solidification it was washed with water and dried to obtain a sheet of continuous porous structure having a fine surface skin layer and good water repellence, of thickness 0.4 mm.

The sheet of continuous porous structure thus obtained was used as mounting member for polishing glass for use in liquid crystals, being stuck on to a lower base plate using double-sided adhesive tape. When a polishing operation was conducted without use of a template, identical results to those of Embodiment 1 were obtained.

What is claimed is:

1. Mounting member for polishing provided on a base plate and comprising:

a sheet of continuous porous structure made of resin having a surface skin layer of fine porous structure, wherein water repellence is conferred on at least the surface skin layer of this sheet of continuous porous structure.

2. A mounting member for polishing according to claim 1, wherein the sheet of continuous porous structure is manufactured of polyurethane resin.

3. A mounting member for polishing according to claim 1, wherein water repellence is conferred by a water repellent agent containing at least 1% by weight of fluorine-based water-repellent agent.

* * * * *